US012467122B2

(12) United States Patent
Marya

(10) Patent No.: US 12,467,122 B2
(45) Date of Patent: Nov. 11, 2025

(54) HIGH CARBIDE CAST AUSTENITIC CORROSION RESISTANT ALLOYS

(71) Applicant: Schlumberger Technology Corporation, Sugar Land, TX (US)

(72) Inventor: Manuel Marya, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 332 days.

(21) Appl. No.: 18/005,996

(22) PCT Filed: Jul. 13, 2021

(86) PCT No.: PCT/US2021/041354
§ 371 (c)(1),
(2) Date: Jan. 19, 2023

(87) PCT Pub. No.: WO2022/020134
PCT Pub. Date: Jan. 27, 2022

(65) Prior Publication Data

US 2023/0349275 A1 Nov. 2, 2023

Related U.S. Application Data

(60) Provisional application No. 63/053,786, filed on Jul. 20, 2020.

(51) Int. Cl.
*E21B 43/12* (2006.01)
*C21D 5/00* (2006.01)
(Continued)

(52) U.S. Cl.
CPC ..... *C23C 8/68* (2013.01); *C21D 5/00* (2013.01); *C22C 30/00* (2013.01); *C22C 37/08* (2013.01);
(Continued)

(58) Field of Classification Search
None
See application file for complete search history.

(56) References Cited

U.S. PATENT DOCUMENTS 4,929,288 A 5/1990 Borges
5,246,661 A 9/1993 Culling
(Continued)

FOREIGN PATENT DOCUMENTS

JP 2015514865 A 5/2015

OTHER PUBLICATIONS

ASM International Handbook Committee. (1991). ASM Handbook, vol. 04—Heat Treating (pp. 258-267). ASM International. (Year: 1991).*

(Continued)

*Primary Examiner* — Anthony M Liang
(74) *Attorney, Agent, or Firm* — Jeffrey D. Frantz

(57) ABSTRACT

Cast alloys comprising 20 to 35 wt. % nickel; 25% to 42.5 wt. % chromium; 1.5 to 2.5 wt. % carbon; 0.5 to 2.0 wt. % manganese; 0.25 to 2.0 wt. % silicon; 0 to 1.5 wt. % aluminum; 0 to 0.5 wt. % titanium, niobium, tantalum combined, 0 to 1 wt. % copper, other residual elements up to 0.5 wt. %, and iron to bring the total percentage to 100 wt. %, are described. The cast alloys can be used to form components for mixers, turbines and pumps, such as impellers, diffusers, and spacers, or for fracking operations as seats or flow diverters, as well as other oil and gas or energy industry components. In some applications, the cast alloys are custom made for downhole electro submersible pump applications.

17 Claims, 6 Drawing Sheets

(51) Int. Cl.

| | |
|---|---|
| ***C22C 30/00*** | (2006.01) |
| ***C22C 37/08*** | (2006.01) |
| ***C23C 8/20*** | (2006.01) |
| ***C23C 8/24*** | (2006.01) |
| ***C23C 8/68*** | (2006.01) |

(52) U.S. Cl.
CPC ..... *C23C 8/20* (2013.01); *C23C 8/24* (2013.01); *C21D 2211/001* (2013.01)

(56) References Cited

U.S. PATENT DOCUMENTS

| | | | | |
|---|---|---|---|---|
| 5,320,801 | A | 6/1994 | Culling | |
| 6,165,288 | A | 12/2000 | Dwars | |
| 9,222,154 | B2 | 12/2015 | Dolman | |
| 2004/0258554 | A1* | 12/2004 | Radon | C22C 30/00 420/12 |
| 2005/0183794 | A1 | 8/2005 | Okada | |
| 2008/0141826 | A1 | 6/2008 | Marya | |
| 2008/0236842 | A1 | 10/2008 | Bhavsar | |
| 2011/0200843 | A1 | 8/2011 | Osuki | |
| 2018/0291907 | A1* | 10/2018 | Ye | F04D 13/10 |

OTHER PUBLICATIONS

ASTM A532 Standard Specification for Abrasion-Resistant Cast Irons, Originally approved in 1965 (4 pages).
ASTM E436 Standard Test Method for Drop-Weight Tear Tests of Ferritic Steels, originally approved in 1971 (6 pages).
ASTM A439 Standard Specification for Austenitic Ductile Iron Castings, originally approved in 1960 (7 pages).
ASTM E18-07 Standard Test Methods for Rockwell Hardness of Metallic Materials, originally approved in 1932 (39 pages).
ASTM E384 Standard Test Method for Microindentation Hardness of Materials, originally approved in 1969 (40 pages).
ASTM A751 Standard Test Methods, Practices, and Terminology for Chemical Analysis of Steel Products, originally approved in 1977, (6 pages).
International Search Report and Written Opinion issued in PCT Application PCT/US2021/041354, dated Oct. 29, 2021 (12 pages).
ASTM A436 Standard Specification for Austenitic Gray Iron Castings, originally approved in 1959 (5 pages).

* cited by examiner

A B

C D

FIGURE 5: List of inventive alloys (by weight percent, Fe as balance element).

| # | Cr | Ni | C | Al | Mo | Others | % Carbides | %Cr in Binder (550°C) | %Ni in Binder (550°C) | $T_{ferrite}$ (°C) |
|---|---|---|---|---|---|---|---|---|---|---|
| 1 | 40.00 | 35.00 | 1.75 | 0.00 | 2.50 | Mn=0.5; Si=0.5 | 32.0 | 19.5 | 51.2 | 578.0 |
| 2 | 40.00 | 30.00 | 1.75 | 0.00 | 2.50 | Mn=0.5; Si=0.5 | 32.0 | 17.6 | 45.2 | 616.8 |
| 3 | 40.00 | 25.00 | 1.75 | 0.00 | 2.50 | Mn=0.5; Si=0.5 | 32.0 | 16.9 | 38.3 | 645.8 |
| 4 | 40.00 | 20.00 | 1.75 | 0.00 | 2.50 | Mn=0.5; Si=0.5 | 32.1 | 16.5 | 31.0 | 669.4 |
| 5 | 35.00 | 35.00 | 1.75 | 0.00 | 2.50 | Mn=0.5; Si=0.5 | 32.1 | 13.3 | 51.0 | 226.3 |
| 6 | 35.00 | 30.00 | 1.75 | 0.00 | 2.50 | Mn=0.5; Si=0.5 | 32.1 | 13.5 | 43.8 | 313.5 |
| 7 | 35.00 | 25.00 | 1.75 | 0.00 | 2.50 | Mn=0.5; Si=0.5 | 32.1 | 13.6 | 36.5 | 386.4 |
| 8 | 35.00 | 20.00 | 1.75 | 0.00 | 2.50 | Mn=0.5; Si=0.5 | 32.1 | 13.8 | 29.2 | 449.4 |
| 9 | 30.00 | 30.00 | 1.75 | 0.00 | 2.50 | Mn=0.5; Si=0.5 | 32.2 | 8.3 | 43.5 | 345.5 |
| 10 | 30.00 | 25.00 | 1.75 | 0.00 | 2.50 | Mn=0.5; Si=0.5 | 32.2 | 8.4 | 36.3 | 408.8 |
| 11 | 30.00 | 20.00 | 1.75 | 0.00 | 2.50 | Mn=0.5; Si=0.5 | 32.2 | 8.6 | 29.1 | 466.9 |
| 12 | 25.00 | 25.00 | 1.75 | 0.00 | 2.50 | Mn=0.5; Si=0.5 | 31.1 | 5.0 | 35.5 | 431.7 |
| 13 | 25.00 | 20.00 | 1.75 | 0.00 | 2.50 | Mn=0.5; Si=0.5 | 32.4 | 4.7 | 28.8 | 484.4 |
| 14 | 35.00 | 30.00 | 1.50 | 1.00 | 2.50 | Mn=0.5; Si=0.5 | 27.6 | 14.6 | 42.8 | 628.9 |
| 15 | 35.00 | 30.00 | 1.75 | 1.00 | 2.50 | Mn=0.5; Si=0.5 | 32.1 | 13.0 | 43.9 | 342.7 |
| 16 | 35.00 | 30.00 | 2.00 | 1.00 | 2.50 | Mn=0.5; Si=0.5 | 36.5 | 9.2 | 46.7 | 333.3 |
| 17 | 35.00 | 30.00 | 2.25 | 1.00 | 2.50 | Mn=0.5; Si=0.5 | 41.1 | 6.0 | 49.8 | 344.7 |
| 18 | 35.00 | 30.00 | 2.50 | 1.00 | 2.50 | Mn=0.5; Si=0.5 | 41.6 | 5.3 | 50.2 | 360.6 |
| 19 | 37.50 | 25.00 | 1.85 | 1.50 | 2.75 | Mn=0.5; Si=0.5 | 33.9 | 13.0 | 38.6 | 607.3 |
| 20 | 37.50 | 25.00 | 1.85 | 1.50 | 2.50 | Mn=0.5; Si=0.5 | 33.8 | 13.0 | 38.5 | 601.2 |
| 21 | 37.50 | 25.00 | 1.85 | 1.50 | 2.25 | Mn=0.5; Si=0.5 | 33.7 | 13.0 | 38.3 | 595.0 |
| 22 | 37.50 | 25.00 | 1.85 | 1.50 | 2.00 | Mn=0.5; Si=0.5 | 33.5 | 14.1 | 37.5 | 427.5 |
| 23 | 37.50 | 25.00 | 1.85 | 1.50 | 1.75 | Mn=0.5; Si=0.5 | 33.5 | 13.9 | 37.4 | 425.4 |
| 24 | 38.75 | 22.50 | 1.93 | 0.75 | 2.25 | Mn=0.5; Si=0.5 | 35.1 | 15.1 | 34.5 | 426.0 |
| 25 | 38.75 | 26.50 | 1.93 | 0.75 | 2.25 | Mn=0.5; Si=0.5 | 35.1 | 14.9 | 43.4 | 366.5 |
| 25 | 42.50 | 25.00 | 2.00 | 0.50 | 2.75 | Mn=0.5; Si=0.5 | 36.6 | 15.4 | 41.4 | 670.2 |
| 25 | 42.50 | 25.00 | 2.50 | 0.50 | 2.75 | Mn=0.5; Si=0.5 | 45.4 | 10.4 | 45.2 | 336.0 |

FIGURE 5A

FIGURE 5: List of inventive alloys (by weight percent, Fe as balance element).

| # | Cr | Ni | C | Al | Mo | Others | % Carbides | %Cr in Binder (550°C) | %Ni in Binder (550°C) | $T_{ferrite}$ (°C) |
|---|---|---|---|---|---|---|---|---|---|---|
| MIN | 25.00 | 20.00 | 1.50 | 0.00 | 1.75 | | 27.6 | 4.7 | 28.8 | 226.3 |
| MAX | 42.50 | 35.00 | 2.50 | 1.50 | 2.75 | | 45.4 | 19.5 | 51.2 | 670.2 |

FIGURE 6: Additional inventive alloys with minor changes in Si, Al, Mo, Ti, Nb, Ta and Cu contents (by weight percent, Fe as balance element).

| # | Cr | Ni | C | Mn | Si | Others | % Carbides | %Cr in Binder (550°C) | %Ni in Binder (550°C) | $T_{ferrite}$ (°C) |
|---|---|---|---|---|---|---|---|---|---|---|
| 26 | 35.00 | 25.00 | 1.50 | 0.00 | 0.00 | Al=1<br>Mo=2.25 | 29.9 | 15.1 | 35.5 | 618.1 |
| 27 | 35.00 | 25.00 | 1.50 | 2 | 0 | Al=1<br>Mo=2.25 | 30.7 | 14.3 | 35.9 | 643.9 |
| 28 | 35.00 | 25.00 | 1.50 | 0 | 2 | Al=1<br>Mo=2.25 | 27.7 | 13.0 | 36.6 | 670.0 |
| 29 | 35.00 | 25.00 | 1.50 | 1 | 1 | Al=1<br>Mo=2.25 | 27.5 | 13.5 | 36.2 | 644.8 |
| 30 | 35.00 | 25.00 | 1.50 | 2 | 2 | Al=1<br>Mo=2.25 | 27.8 | 12.3 | 37.1 | 700.3 |
| 31 | 35.00 | 25.00 | 1.50 | 2.0 | 1 | Al =1<br>Mo=1.75<br>Ti = 0.25<br>Nb = 0.25 | 25.9 | 13.0 | 36.4 | 702.9 |
| 32 | 35.00 | 25.00 | 1.50 | 2.0 | 1 | Al =1<br>Mo=1.75<br>Ti = 0.25<br>Ta = 0.25 | 26.2 | 13.0 | 36.4 | 695.2 |
| 29b | 35.00 | 25.00 | 1.50 | 1 | 1 | Al=1<br>Mo=2.25<br>Cu = 0.5 | 27.5 | 13.1 | 36.4 | 669.8 |
| 29c | 35.00 | 25.00 | 1.50 | 1 | 1 | Al=1<br>Mo=2.25<br>Cu = 1.0 | 27.5 | 12.7 | 36.6 | 683.5 |

FIGURE 5B

HIGH CARBIDE CAST AUSTENITIC CORROSION RESISTANT ALLOYS

CROSS-REFERENCE TO RELATED APPLICATIONS

The present application is a National Stage of International Application No. PCT/US2021/041354, filed Jul. 13, 2021, which claims priority benefit of U.S. Provisional Application No. 63/053,786 filed Jul. 20, 2020, the entirety of which is incorporated by reference herein and should be considered part of this specification.

FIELD OF THE INVENTION

All oilfield assets gradually deteriorate due to a combination of environmental and operational factors, including abrasive wear, liquid and sand erosion, corrosive aqueous fluids like acids, or production fluids containing water with sour gas ($H_2S$), carbon dioxide ($CO_2$), chlorides ($Cl^-$), among others. For example, an electric submersible pump (ESP) may suffer concurrently from abrasion, erosion, and corrosion resulting in the gradual removal of materials on each pump stage, that is impeller, diffuser, and spacer. The result is less effective pumping, increased vibrations and shocks over time, and the failure or the premature decommissioning of the pump. Improving the wear and corrosion resistance of pump stages (FIG. 1) can lower overall asset and maintenance costs, and potentially allow the pumping of fluids at higher revolution per minute, or rpm.

In oilfield equipment used at the surface, the performance and total cost of ownership of surface pumping assets such as vortex mixers, blenders, and the like also depends on cast alloys effectively combining abrasion, erosion, and corrosion resistance. These include large cast slingers and impellers that are rotating with significant inertia at elevated rpm, typically in the order of 3000 rpm (FIG. 2). During their lifetime, these components are exposed simultaneously to atmospheric conditions, especially water and abrasive proppants that include sand particles. Even though corrosion is considered more of a secondary problem than in the case of ESPs, corrosion remains present and is accelerated with acids and entrapped or stagnant waters.

The life of rotating hardware, such as blenders, pumps, and the like, has improved greatly in past decade due to engineering redesigns as well as use of harder cast alloys such as white irons per ASTM A532. However, the castability of such alloys is limited and restricted to few foundries skilled in the art of shaping these very hard cast alloys. In addition, the typical slinger and impeller components are not optimized for corrosion in strong acids. For ESPs, there has not been any noteworthy innovation with new stage alloys in decades. The so-called Ni-resist alloys as per ASTM A436 or A439 and the like have been in use and remain greatly limited in performance, whereas other cast alloys such as white irons are inherently too brittle and susceptible to various forms of corrosion in a downhole ESP environment.

Thus, there is a technological need for improved cast alloys, that is, new alloys exhibiting greater corrosion, erosion, and abrasion resistance than the alloys in current use. Such alloys should have a corrosion performance closer to some of nickel-base superalloys in use downhole in non-cast products. These new alloys should also remain readily castable, particularly using an air melt practice along with traditional casting processes. Such alloys are not required to be as hard and cracking susceptible as the white irons in use in mining or for selected surface assets, but they are required to balance a set of properties demanded by new products for the oilfield services.

SUMMARY

Cast alloys with greater corrosion, erosion, and abrasion resistance than cast alloys currently used in the oilfields like Ni-resist Type 1 and 4 are demanded by novel oilfield applications to bring cost reduction and increased efficiency. The cast alloys of this invention comprise 20 to 35 wt. % nickel (Ni), 25% to 42.5 wt. % chromium (Cr), 1.5 to 2.5 wt. % carbon (C), 0.5 to 2.0 wt. % manganese (Mn), 0.25 to 2.0 wt. % silicon (Si), 0 to 1.5 wt. % aluminum; 0 to 0.5 wt. % titanium, niobium, tantalum combined, 0 to 1 wt. % copper, other residual elements up to 0.5 wt. %, and iron as the remainder (balance) to bring the total percentage to 100 wt. %. Like Ni-resist Type 1, the alloys are manufactured at a competitive cost and with an intentionally austenitic matrix, unlike the white irons per ASTM A532 for instance.

Other chemical elements are always present as residual elements or impurities with each element usually below 0.1 wt. % for a cumulated total less than 0.5 wt. %. Among residual elements are oxygen, phosphorous, sulfur, all three usually measured down to the ppm levels. Following normal air melting, nitrogen may be present in the alloy, as several metallic elements not accounted for by design. Nitrogen in the austenitic matrix can be beneficial to improve corrosion, even at levels as low as 0.1 wt. %. Nitrogen introduction into an alloy is often a consequence of the alloy composition itself, especially a high chrome content.

The cast alloys of the invention may be used for downhole, surface, or subsea pump components, mixer components, and turbines, with main applications for centrifugal staged pump stages like electric submersible pumps and horizontal pumping system stages. Stages consist of impellers, diffusers, spacers, among other small parts. The cast alloys of the invention are also applicable for use in fracking or fracturing, including for seats, receptables, flow diverters, and other energy industry articles that are intended for the transport of corrosive fluids, such as produced waters, crude oil, and the like.

Since the novel cast alloys are non-graphitic, unlike Ni-resist alloys from the prior art, self-lubrification is inherently limited. Thus, articles made of the inventive alloys tend to be more prone to galling, or seizing when two surfaces of the same materials move against each other. However, the inventive cast alloys respond well to traditional surface treatments by thermal diffusion. These are intended to improve surface hardness, wear resistance, and minimize risks of galling. Currently pump stages are not commonly surface treated for increased wear resistance, exception of some cases of boronizing for special high-wear applications. In contrast to prior art alloys, the inventive alloys possess chemical compositions that have been customized to respond to such hardening surface treatments, particularly with nitrogen as in cases of nitriding and carbonitriding.

The inventive alloys uniquely include large percentages of carbides, between 25 and 45%, in a nickel-rich austenite phase with preferably 9 wt. % min of chromium. The cast alloys exhibit an austenitic matrix structure, and the main component binding the in-situ formed carbides phases is the typical crystal structure of nickel, or of iron when the iron is rich in nickel, manganese, nitrogen or other elements considered to be austenite stabilizers. Having a continuous austenite phase binding discontinuous hard carbide phases, the cast alloys of this invention are non-magnetic, though residual magnetism is a possibility at mass production levels mainly due to elemental segregation.

Due to its balanced chemical composition, the cast alloys of this invention also have a chemical affinity for carbonitriding, nitriding, boriding or boronizing, among other surface treatments. By enabling the accelerated formation of hard and adherent lubricative layers through thermal diffusion surface treatments, the performance of pumps, mixers, blenders and other rotating asset can be improved. With novel chemical compositions, especially increased nickel and chromium-rich austenite compositions as compared to that of the Ni-resist alloys, the inventive alloys are highly resistant to sour fluids, in addition to being suitable for some water service applications. To the inventors' knowledge, these inventive cast alloys are the first to be customized for downhole oilfield pumping applications, including production from the subterranean reservoir, as well as injection.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

All concentrations of chemical elements herein are by weight percent ("wt. %") unless otherwise specified.

The terms "metals", "alloys", "materials" are used interchangeably through this document. An alloy is a mixture of metallic and non-metallic elements. Metal and materials are broader designations.

"Heat treatment" is any one of several controlled heating and cooling operations used to bring about a desired change in the properties of a metal or alloy. Its purpose is generally to improve the structural properties for some particular use. There are various heat-treating processes such hardening, annealing, austenitizing, tempering, or ageing. Although each of these processes bring about different results, all of them involve three basic steps: heating, soaking, and cooling.

"Heating" is the first step in a heat-treating process. Many alloys change structure when they are heated to specific temperatures. The structure of an alloy at room temperature can be either a mechanical mixture, a solid solution, or a combination solid solution and mechanical mixture. A solid solution is when two or more metals are absorbed, one into the other, and form a solution. When an alloy is in the form of a solid solution, the elements and compounds forming the metal are absorbed into each other. A metal in the form of a mechanical mixture at room temperature often goes into a solid solution or a partial solution when it is heated. Changing the chemical composition in this way brings about certain predictable changes in grain size and structure. This leads to the second step in the heat-treating process: soaking.

Once a metallic part has been heated to the temperature at which desired changes in its structure will take place, it must remain at that temperature until the entire part has been evenly heated throughout. This is sometimes known as "soaking."

After the part has been properly soaked, the third step is to cool it. Here again, the structure may change from one chemical composition to another, it may stay the same, or it may revert to its original form. For example, a metal that is a solid solution after heating may stay the same during cooling, change to a mechanical mixture, or change to a combination of the two, depending on the type of metal and the rate of cooling. For that reason, many metals can be made to conform to specific structures in order to increase their hardness, toughness, ductility, tensile strength, and so forth.

Common forms of heat treatment include hardening, tempering, annealing, normalizing, austenitizing, ageing. Not all these heat treatments may be relevant to this invention. A ferrous metal, including steel, is normally "hardened" by heating to the required temperature and then cooling rapidly by plunging the hot metal into a quenching medium, such as oil, water, or brine. The hardening process increases the hardness and strength, but also increases brittleness.

Steel is usually harder than necessary and too brittle for practical use after being hardened. Steel must thus be "tempered" after being hardened. Tempering consists of heating the metal to a specified temperature and then permitting the metal to cool. The rate of cooling usually has no effect on the metal structure during tempering. Therefore, the metal is usually permitted to cool in still air. Temperatures used for tempering are normally much lower than the hardening temperatures.

Metals are "annealed" to soften or make them more ductile, and refine their grain structures. Annealing is heating it to a prescribed temperature, holding at that temperature for the required time, and then cooling back to room temperature. The rate at which metal is cooled from the annealing temperature varies greatly.

"Austenite," known as the gamma-phase iron (γ-Fe) in steels and ferrous alloys, is a non-magnetic allotrope of iron or a solid solution of iron, with an alloying element. The austenite is non-magnetic, ductile, but generally lacks hardness and strength. Corrosion-resistant alloys that can survive the harshest oilfield conditions tend to have a predominant austenitic structure.

"Austenitization" means to heat the iron-based metal to a temperature at which it changes crystal structure from ferrite (body-centered cubic) to austenite (face-centered cubic). The terms austenitization may be extended to alloys wherein iron is no longer the highest percentage of the composition as long as the austenite phase can be present a matrix or binding phase at elevated temperatures.

For some iron-based metals, the presence of carbides may occur during the austenitization step. Carbides are typically controlled to be a very small percentage. High carbides significantly reduce ductility, and usually leads to reduced corrosion resistance, particularly in so-called stainless steels. By "carbides" what is meant is a binary compound composed of carbon and a transition metal. Examples of carbides include $Nb_4C_3$, $Ta_4C_3$, $Cr_{23}C_6$, $Cr_3C$, $Cr_7C_3$, $Cr_3C_2$, $Mo_3C_2$, among others. Carbides may broadly fall under the following designation of $M_xC_y$, where x and y are integral numbers. $M_3C$, $M_7C_3$, $M_{23}C_6$, with M as transition metal element are common in ferrous alloys.

By "nitrided" what is meant is heating an alloy part in an environment rich in nitrogen such as ammonia ($NH_3$) or a nitrogen-releasing liquid salts, such that nitrogen diffuses into the alloy and creates a hard skin of so-called nitrides. Nitriding provides an alternative means of hardening an alloy surface, and is an effective mean of reduce various forms of wear.

Like nitriding, "carbonitriding" increases the surface hardness of a metal. During the process, atoms of carbon and nitrogen diffuse interstitially into the metal, increasing the hardness.

"Boriding" or "boronizing" refer to the process by which boron is introduced to a metal or alloy to cause surface hardening. In this process boron atoms are diffused into the surface of a metal component. The process commonly converts iron into iron boride, consisting of two phases, FeB concentrated near the surface, and $Fe_2B$. Boride layer depths can range from 0.001-0.015 inch depending on base material selection and treatment.

"Casting" is a process in which a metal, typically comprised of various metals, is liquefied at elevated temperatures, and delivered into a mold that contains a negative impression of the intended shape. The metal is poured into the mold through a hollow channel called a sprue, then cooled, and the metal part (the casting) is extracted. Casting is most often used for making complex shapes that would be difficult or uneconomical to make by other methods. Traditional casting techniques include lost-wax casting, plaster mold casting and sand casting.

The modern casting process is subdivided into two main categories: expendable and non-expendable casting. It is further broken down by the mold material, such as sand or metal, and pouring method, such as gravity, vacuum, or low pressure.

"DLC" refers to a diamond-like carbon coating, that is a thin coating produced by PVD, CVD, PACVD and the like, that comprises some carbon in the diamond crystallographic structure. "PVD" refers to Physical Vapor Deposition, "CVD" to Chemical Vapor Deposition, and "PACVD" to Plasma-assisted chemical vapor deposition. All three processes are routinely used to produced very hard surfaces on metals.

"HRC" is Rockwell Hardness measured on the C scale. It is measured by ASTM E 18-07.

"HVN" is Vickers hardness number. It is measured by ASTM E384.

"Cryogenic temperatures" are from −150° C. to −273° C.

DESCRIPTION OF FIGURES

FIGS. 5A-B. Lists of inventive alloys.

FIG. 6. Additional inventive alloys with minor changes in Mn and Si.

DETAILED DESCRIPTION

Figure 1A:
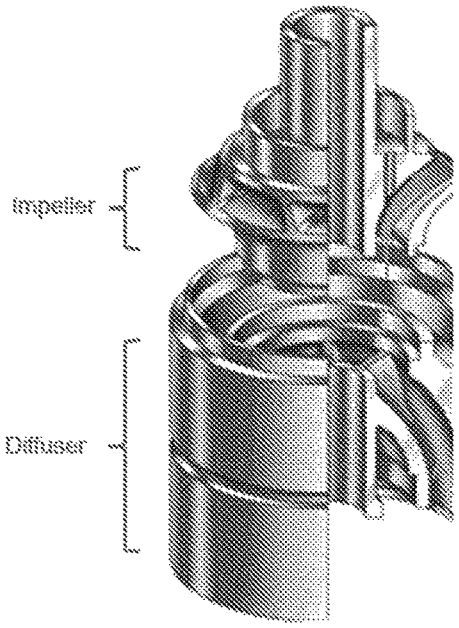
FIG. 1: A typical ESP stage in cutaway (FIG. 1A) with both impeller and diffuser and in cross section (FIG. 1B).
Figure 1B:
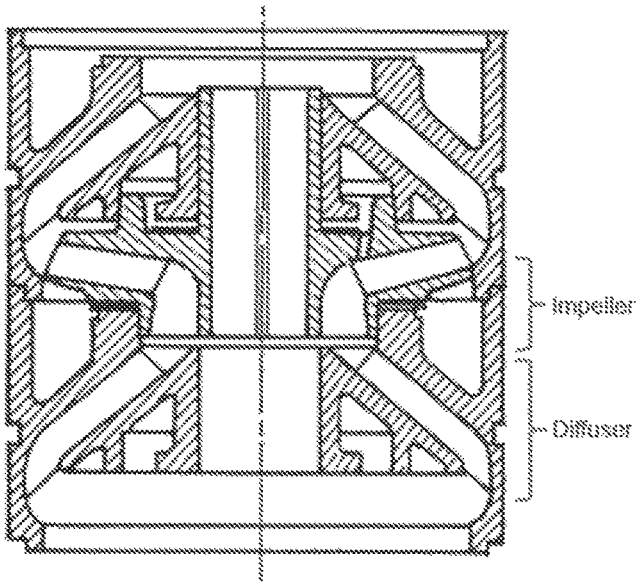
Figure 2:
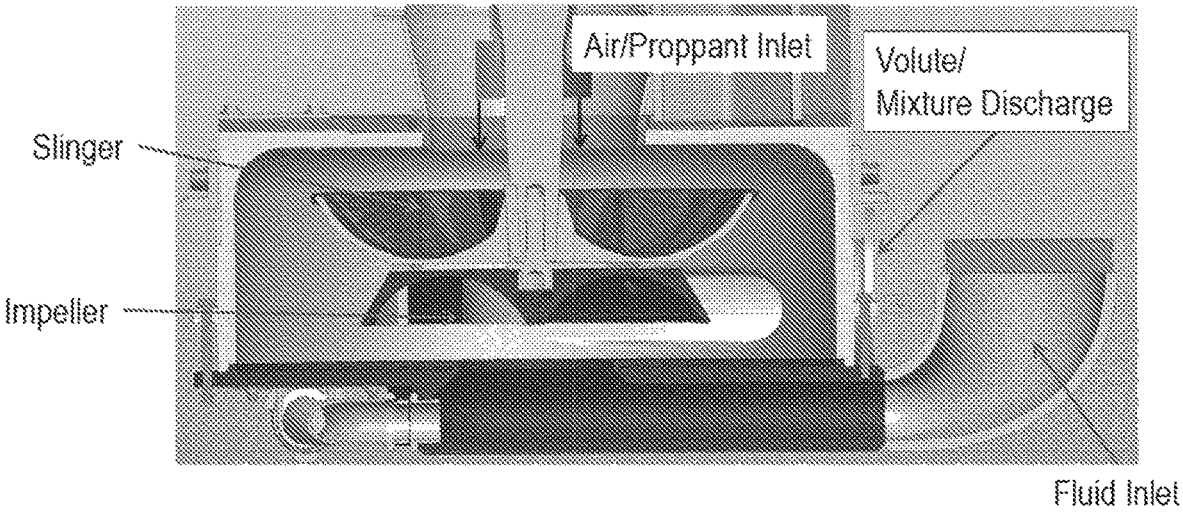
FIG. 2. The typical slinger and impeller of a vortex mixer used in well services.

At the outset, it should be noted that in the development of any such actual embodiment, numerous implementation-specific decisions must be made to achieve the developer's specific goals, such as compliance with system related and business-related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited.

In the summary and this detailed description, each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

PRIOR ART NICKEL RESIST (Ni-RESIST) ALLOYS

Downhole electric submersible pumps, or ESPs, are multi-staged pumps comprising stages wherein each stage has an impeller, diffuser, and spacer. The materials in use are somewhat wear and corrosion resistant, but can be improved. These include high nickel-copper gray cast iron alloys such as Ni-Resist, Type 1 and Type 4, among modified compositions around these two compositions. Ni-resist Type 1 comprises between 13.5 and 17.5 wt. % nickel and 5.0 to 7.5% copper. Due to its higher hardness, Type 4 is preferably used in more abrasive applications. The material price of Type 4 is greater than that of the Ni Resist Type 1, while a manufactured stage may cost several times that of Ni Resist Type 1. Ni-resist alloy compositions may be found in ASTM A436 and ASTM A439, among other standards.

The Ni-Resist cast irons are a family of alloys with enough nickel to produce an austenitic structure. The family is divided into two groups. These are the standard or flake graphite alloys and the ductile or spheroidal graphite alloys. Tables 1 and 2 show chemical compositions and nominal mechanical properties for flake and spheroidal graphite Ni-Resist alloys. The mechanical properties can be varied by heat treatment and by altering the levels of carbon, silicon, chromium and, if desired, molybdenum. Heat treatment may change these alloys considerably. The tensile strength of the flake graphite alloys is similar for all types because the austenite matrix common to all the alloys largely controls the strength level and some variations in strength can be attained by controlling the size, amount, and distribution of graphite flakes through heat treatment.

Among all ESP stage alloys commonly in use, Ni-Resist 1 has the leanest nickel content. Ni-resist Type 1 has reasonably good resistance to corrosion in alkalis, dilute acids, seawater and other salt solutions. It also has good wear resistance at moderate temperatures. Ni-Resist 1b is slightly superior in corrosion and erosion resistance. Higher chromium content produces an alloy that is harder and stronger. In their final microstructures, Ni-resist Type 1 alloys have in the order of 2 to 4% graphite with approximately equal percentages of carbides in an austenitic nickel-rich matrix. The carbides, predominantly $Cr_7C_3$, provides wear resistance through general hardening. The graphite provides lubrication, and as such also reduces abrasive wear.

TABLE 1

Chemical Compositions of Prior Art Flake Graphite Ni-Resist Alloys, wt %.

| Common name | Ni | Cr | Si | Cu | Mn | C max | Other |
|---|---|---|---|---|---|---|---|
| Ni Mn 137 | 12.0-14.0 | 0.2 max | 1.5-3.0 | — | 6.0-7.0 | 3.0 | — |
| Ni-Resist 1 | 13.5•17.5 | 1.5-2.5 | 1.0-2.8 | 5.5-7.5 | 0.5•1.5 | 3.0 | — |
| Ni-Resist lb | 13.5•17.5 | 2.5•3.5 | 1.0-2.8 | 5.5-7.5 | 0.5•1.5 | 3.0 | — |
| Ni-Resist 2 | 18.0-22.0 | 1.5-2.5 | 1.0-2.8 | 0.5 max | 0.5•1.5 | 3.0 | — |
| Ni-Resist 2b | 18.0-22.0 | 3.0-6.0 | 1.0•2.8 | 0.5 max | 0.5•1.5 | 3.0 | — |
| Ni-Resist 3 | 28.0-32.0 | 2.5•3.5 | 1.0•2.0 | 0.5 max | 0.5•1.5 | 2.6 | — |
| Ni-Resist 4 | 29.0-32.0 | 4.5-5.5 | 5.0-6.0 | 0.5 max | 0.5•1.5 | 2.6 | — |
| Ni-Resist 5 | 34.0-36.0 | 0.1 max | 1.0-2.0 | 0.5 max | 0.5•1.5 | 2.4 | — |
| Ni-Resist 6 | 18.0-22.0 | 1.0-2.0 | 1.5-2.5 | 3.5-5.5 | 0.5•1.5 | 3.0 | Mo: 1.0 |

In alloys that are used in as-cast conditions, ferrite is avoided because it reduces the corrosion resistance of Ni-resist alloys. As for other castings, the properties of Ni-resist Type 1 castings depend upon casting thickness or bar diameter. Bars of small diameters have reduced tensile properties due to micro-shrinkage. Bars up to 3-in diameter typically exhibit 25,000 psi tensile strength, while larger diameter bars have 20,000 psi tensile strength. Brinell hardness of Ni-resist Type 1 is typically in the 131-183 range. Brinell hardness of Ni-resist Type 4 ranges between 185 and 280, with the latter being rarely achieved and requiring a very long and costly heat treatment after casting. Ni-resist Type 4 contains approximately 10 to 15% carbides, among $M_6C$ and $M_7C_3$ carbides where M is a transition metal, usually among Cr, Mo, but through minor alloying element additions may also contain Ti, Nb, Ta, among others.

TABLE 2

Mechanical properties of flake graphitic Ni-Resist alloys.

| Alloy | Tensile Strength (MPa) | Compressive Strength (MPa) | Elongation (%) | Elasticity Modulus (MPa × $10^3$) | Brinell Hardness |
|---|---|---|---|---|---|
| NiMn 13 7 | 140-220 | 630-840 | — | 70-90 | 120-150 |
| Ni-Resist 1 | 170-210 (25 ksi) | 700-840 | 2 | 85.105 | 130-185 (SLB) |
| Ni-Resist 1b | 190-240 | 880-1100 | 1-2 | 98.113 | 150.250 |
| Ni-Resist 2 | 170-210 | 700-840 | 2-3 | 85-105 | 120-215 |
| Ni-Resist 2b | 190-240 | 880-1100 | 1-2 | 98-113 | 160-250 |
| Ni-Resist 3 | 190-240 | 700-910 | 1-3 | 98-113 | 120-215 |
| Ni-Resist 4 | 170-240 | 560 | — | 105 | 150-210 |
| Ni-Resist 5 | 120-180 | 580-700 | 1-3 | 74 | 120-140 |
| Ni-Resist 6 | 170-210 | 700-840 | — | — | 130-180 |

Each of the alloying elements in the iron base of the Ni-Resists affects the structure and/or properties in different ways. The intentional additions make important and necessary contributions. The following is a brief synopsis of the unique effects of these substances.

Nickel, Ni: Nickel is the element that gives the Ni-Resist alloys their defining characteristics. Nickel is primarily responsible for the stable austenitic structure and improves corrosion resistance by the formation of protective oxide films. Nickel reduces corrosion in acids and alkalis, generally rendering cast ions immune when present in excess of 18 wt. %. Nickel is not as common as alloying elements, such as chromium and silicon, for enhancing corrosion. It is much more important for raising mechanical properties throughout a wide temperature range.

Chromium, Cr: The most important effects of chromium are improvements in strength and corrosion resistance at elevated temperatures. It also causes increased hardness which improves wear and corrosion resistance by the formation of protective oxide films. Chromium decreases ductility by forming a higher percentage of hard carbides. Chromium oxides will resist oxidizing acids, but may be ineffective under reducing conditions.

Copper, Cu: Copper improves corrosion resistance in mildly acidic solutions. Up to 10 wt. % may be used in Ni-resist alloys to increase corrosion resistance. Copper interferes with the magnesium treatment used to produce spheroidal graphite and cannot be added to ductile Ni-resists.

Carbon, C: Carbon is a characteristic element in all cast irons. High carbon reduces the solidification temperature and improves the melting and pouring behavior. Lower carbon contents usually lead to fewer carbides and higher strength and toughness.

Silicon, Si: Silicon is another important element in cast irons. It improves fluidity of the melt, which leads to better casting properties, especially for thin-walled sections. Silicon also increases high temperature corrosion resistance. This element lessens chromium carbide formation.

Manganese, Mn: Manganese provides no improvements in corrosion resistance, high temperature or mechanical properties. However, it is an austenite stabilizer that makes important contributions to the low temperature properties of Ni-Resist and to the non-magnetic alloys such as Ni-Resist NiMn 13 7.

Niobium, Mn: Niobium is an important addition agent that leads to the improved weldability of Ni-Resist. Control of silicon, sulfur and phosphorous are also necessary for maximum effect. It will probably have similar effects in other compositions.

Molybdenum, Mo: Molybdenum is not specified in the various grades of Ni-Resist alloys, but about 2 wt. % is sometimes added for improved high temperature strength.

When held in solution in the ferrous austenitic matrix, molybdenum improves corrosion resistance, including pitting resistance and resistance against stress and sulfide-stress cracking.

Magnesium, Mg: A necessary ladle addition that leads to the formation of spheroidal graphite in the ductile Ni-Resists. Only a very small quantity is present in castings.

HIGH CARBIDE AUSTENITIC ALLOYS

The Ni-Resist alloys above were not purposely formulated for ESPs, but for chemical pumps and engine parts. Overall, these alloys have also not evolved in decades, and novel alloys compositions have not been tuned to the oilfield evolving markets' needs. This invention discloses new cast alloys that at least in part replace Type 4 alloys, and thus make possible a whole new generation of pumping systems, among other applications for the handling and transport of corrosive fluids.

The alloys of this invention have been designed specifically for downhole pumping uses, per a set of criteria derived from experience, test data, and a significant amount of iterative computational materials design. The novel alloys have a chemical composition with 20 to 35 wt. % nickel; 25% to 42.5 wt. % chromium; 1.5 to 2.5 wt. % carbon; 0.5 to 2.0 wt. % manganese; 0.25 to 2.0 wt. % silicon; 0 to 1.5 wt. % aluminum; 0 to 0.5 wt. % titanium, niobium, and tantalum combined, 0 to 1 wt. % copper, other residual elements up to 0.5 wt. %, and with iron to bring the total percentage to 100.

Figure 3:
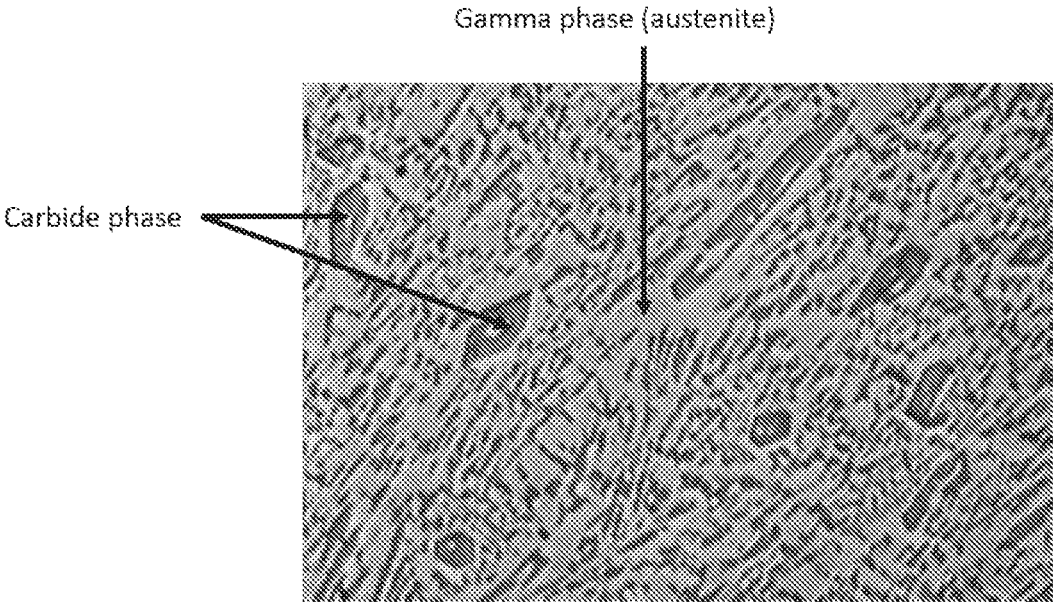
FIG. 3. As-cast microstructure of one example of the inventive alloys.
Figure 4:
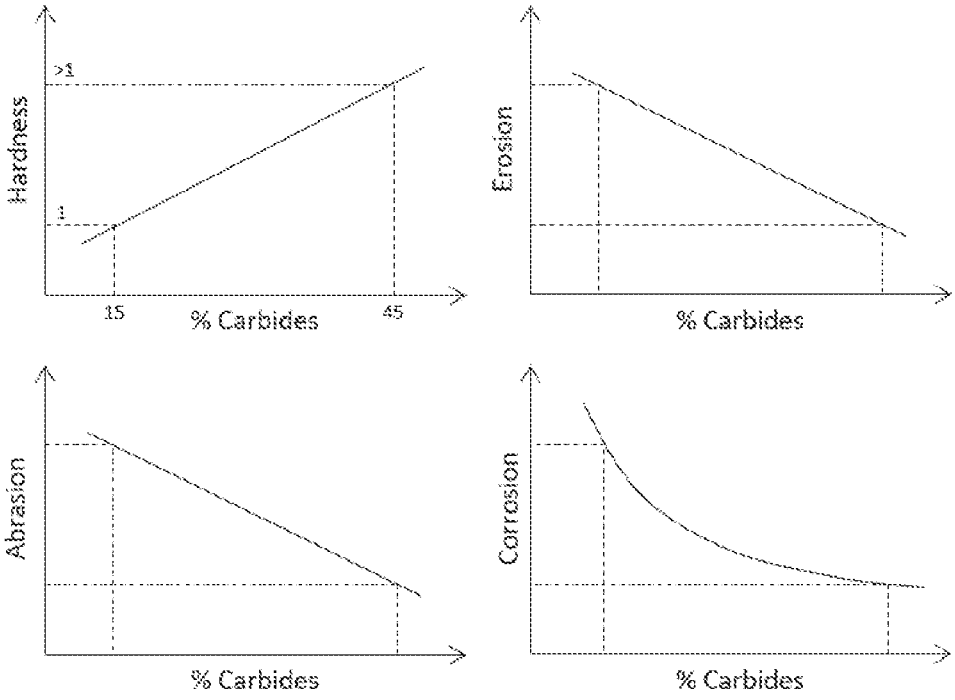
FIGS. 4A-D. The beneficial advantages of some of the inventive alloys.

The microstructure of a sample of one inventive alloy is shown as FIG. 3. Note the presence of the two major phases (by intent) described by the attributes below. Unlike Ni-resist alloys, the inventive alloys are free of graphite, while their carbide content is typically increased 50 to 200% over the prior Ni Resist alloys (FIG. 4). Unlike Ni-resist, the inventive alloys contain significant carbides, particularly molybdenum carbides in addition to chromium carbides. When titanium tantalum, and niobium are included, these also form additional carbides.

Percentages of each phase, as well as chemical compositions of each phase may be routinely established and validated using a set of techniques and methods including computational, and experimental, both well known for those familiar with the art. Phase percentages are most simplistically determined using microscopic techniques based on image analysis area percentage calculations, alone or in combination with x-ray diffraction techniques. Phase compositions can be validated using energy or wavelength dispersive spectroscopy, as commonly done within a scanning electron microscope. Temperatures at which phase appear or vanish when materials are cycled in temperatures can be determined by thermal analyses. ASTM A751, among others, provides test methods for chemical analyses that are applicable to the inventive alloys.

The following was used as set criteria for design:

Total percentage of carbides (at 550° C.): target of 25 to 45 wt. %. Carbides are hard, and may be considered as ceramic materials. In cast irons, they are produced in-situ, as the alloys solidify and further cool down to room temperature. The higher the carbide content, the harder and more brittle the alloy. Exceeding 45% make the material crack-susceptible, and is thus avoided.

Total percentage of Cr in the austenite binding phase (at 550° C.): target 9.0% minimum. Chromium is required to produce carbides and make the alloy stainless-like (typically necessitates ~12%). Chromium is partitioned between two types of phases as the alloy cools down from its liquid phase at high temperatures. Chromium is found as (i) part of carbides, and (ii) as part of a nickel-rich phase referred as gamma phase or austenite. Chromium in solution within this nickel rich austenite binding phase provides corrosion resistance. Typically 12% is the value that defines stainless for steel; herein, and based on experience, a value of 9.0% is set as minimum target value.

Total percentage of Ni in the austenite binder phase (at 550° C.): target 42% maximum. Nickel provides corrosion resistance along with chromium. In analogy with structural alloys in use (carbide-free by intention), a minimum value of nickel near 25% in the gamma austenite binder phase is believed to be useful. Exceedingly approximately 42% is deemed unnecessary based on experience with nickel alloys.

Ferrite formation temperature (at equilibrium, or conditions of infinitely slow cooling): below 500° C. Ferrite is not desirable in the inventive alloys. The lower the value of the ferrite formation temperature, the better. A value of 500° C. has been semi-arbitrarily selected from experience. 550° C. is also a typical surface treatment temperature, and these treatments are recommended to be applied when the alloy is totally austenitic—that is only displays the gamma phase.

FIG. 5 shows exemplary cast alloy formulations of the present disclosure, many with desirable characteristics. In color are shown specific cells that help understand the effect of various alloy elements, well understanding it is their combinations and their use for specific methods and applications that makes the materials innovative.

Based on the table, the following may be observed with respect to each alloying elements, sometimes with effects different that described earlier for the Ni-resist alloys.

Nickel (Ni): Increasing nickel (blue cells) results in more nickel in the gamma phase (austenite) and decreases the ferrite formation temperature, meaning nickel stabilizes austenite towards lower temperature (as expected).

Chromium (Cr): Increasing chromium (green cells) results in more chromium in the gamma phase, and also decreases the ferrite formation temperature.

Carbon (C): Increasing carbon (yellow cells) results in less free chromium in the gamma phase due to an increase in carbides, slightly more nickel in the gamma phase, and a major decrease in the ferrite formation temperature. Carbon also stabilizes the austenite phase.

Aluminum (Al): Increasing aluminum results in little change in the phase ratio, but changes ferrite formation temperature significantly while the aluminum remains in solution in the austenite.

Molybdenum (Mo): Increasing molybdenum (orange cells) results largely in raising the ferrite formation temperature as well as increasing the corrosion resistance of the austenite.

Manganese (Mn) and Silicon (Si): Both have small effects and may be added to several percent, although it is preferred to keep their percentages low. The major effects of these elements are on the ferrite formation temperatures, as shown with other alloys listed in FIG. 6.

Titanium (Ti), niobium (Nb), tantalum (Ta): these elements are strong carbide formers, and their introduction in the alloys, as well as increasing their percentage, frees more chromium, thereby stabilizing the ferrite phase towards greater temperatures.

Copper (Cu), in small percentages, has minor effects on the phase balance and is predominantly found in the austenite phase. It also stabilizes the ferrite phase towards greater temperatures.

The cast alloys made herein can be manufactured by any process known in the art, but we have used sand casting. For the purpose of making ESP stages and mixer parts, we first cast the parts by blending various metals and elements required by the final alloy compositions using an air melt process. Upon melting and dissolving the more refractory elements at temperatures in excess of 1500° C., the alloys were poured into sand molds, allowed a slow cooling in the molds prior to a final removal from the molds. Following various inspections, and the absence of major defects such as porosity or cracks, some castings were subjected final machining and surface treatments, especially nitriding. Nitriding resulted in thicker surface layers than in Ni-resist alloys.

In some cases, more than one surface treatment may be used; for instance, a nitriding or carbonitriding process to produce a nitride layer followed by a secondary process being a coating process and aimed at forming a hard top coat, among the following TiN, TiAlCrN, TiAlN, CrN, Ti(B,C,N), TiCN, or a DLC. The use of such secondary coating process enables surface hardness to be in excess of 1200 HVN, in cases as high as 3500 HVN, and depending upon coatings can reduce friction down to approximately 0.05 to 0.1. This methodology of casting, machining, surface treatments can be applied to any pump or mixer or other oilfield asset, including but not limited to the impeller, a propeller, a diffuser, a flow diverter, a slinger, a ring, a seat, cams, gears, spacers, and the like.

Figure 7:
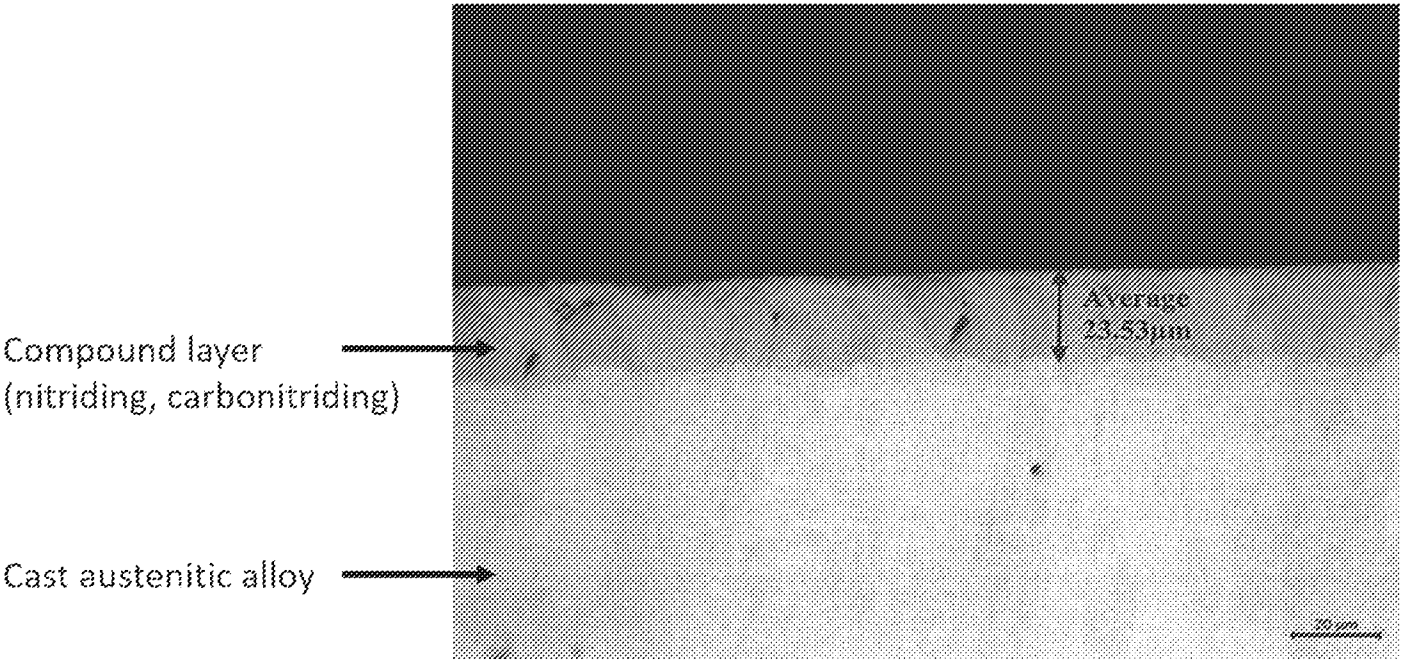
FIG. 7 Typical compound layer in a nitrided inventive alloy, with a compound layer of approximately 25 micrometers in thickness and 65 HRC hardness.
Figure 8:
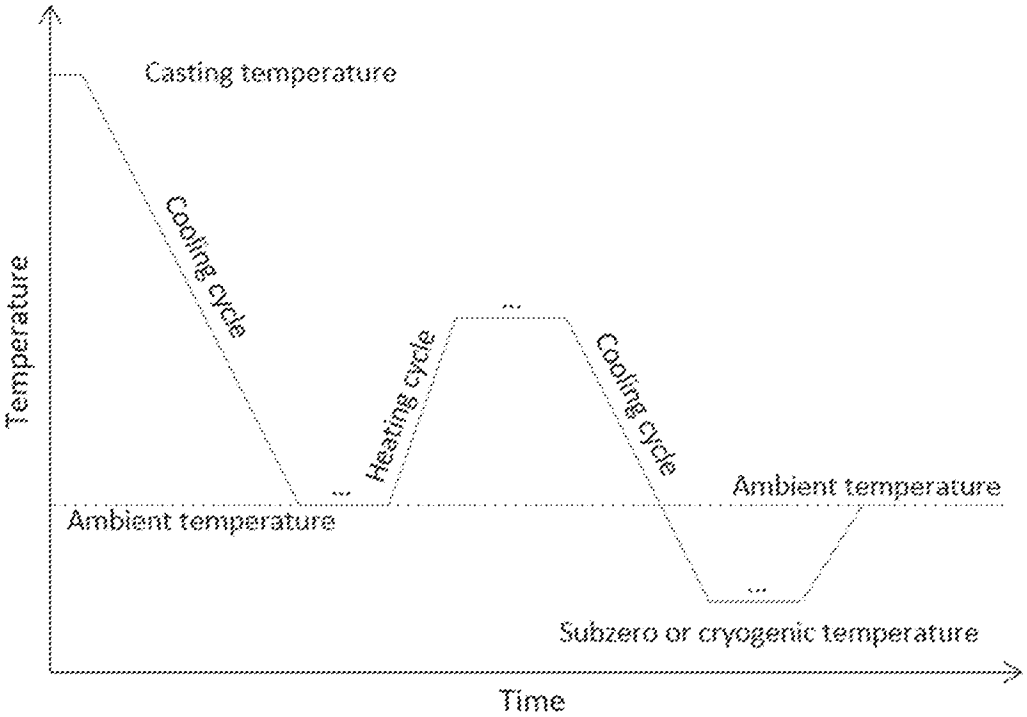
FIG. 8. Schematic view of the casting process.

In some cases, heat-treating may be applied after casting. FIG. 7 shows a complex heat-treatment cycle that encompasses typical heat-treatment. The first cycle, achieved at a temperature to homogenize the casting, may be used to produce a maximum percentage of austenite phase with chromium and carbide percentage as in the alloys of FIG. 5. Suitable heat-treatment temperatures are above the ferrite formation temperature, usually by at least 25° C. The second cycle, more uncommon, is a cooling to above 0° C., or lower, and in some cases even to cryogenic temperature. Use of such heat-treatment can results in slight improvements in hardness, among other properties. When utilizing a subzero treatment, surface treatments and coating processes are generally applied last.

The statements made herein merely provide information related to the present disclosure and may not constitute prior art, and may describe some embodiments illustrating the invention. In particular, the following references may generally relate to certain subject matters of the current application and are hereby incorporated by reference to the current application in their entireties for all purposes:

ASTM E18-07 Standard Test Methods for Rockwell Hardness of Metallic Materials

ASTM E384 Standard Test Method for Microindentation Hardness of Materials

ASTM A532 Standard Specification for Abrasion-Resistant Cast Irons

ASTM A436 Standard Test Method for Drop-Weight Tear Tests of Ferritic Steels

ASTM A439 Standard Specification for Austenitic Ductile Iron Castings

ASTM A751 Standard Test Methods, Practices, and Terminology for Chemical Analysis of Steel Products US20050183794 Cast iron material, seal material and the production method U.S. Pat. No. 4,929,288 Corrosion and abrasion resistant alloy U.S. Pat. No. 5,320,801 High carbon high chromium alloys having corrosion and abrasion resistance U.S. Pat. No. 6,165,288 Highly corrosion and wear resistant chilled casting U.S. Pat. No. 9,222,154 Wear resistant cast iron

The invention claimed is:

1. A component of an electric submersible pump made by casting an austenitic alloy consisting of: from 25 to 35 wt. % nickel; 25% to 42.5 wt. % chromium; 1.5 to 2.5 wt. % carbon; 0.5 to 2.0 wt. % manganese; 0.25 to 2.0 wt. % silicon; 0 to 1.5 wt. % aluminum; 0 to 0.5 wt. % of a combination of titanium, niobium, and tantalum, 0 to 1 wt. % copper, residual elements 0 to 0.5 wt. %, and iron as the remainder to bring the total percentage to 100 wt. %.

2. The component of claim 1, wherein nickel is 25 to 30 wt. %; chromium is 30 to 40 wt. %; carbon is 1.5 to 2.0 wt. %; manganese is 0.50 to 1.50 wt. %; and silicon is 0.25 to 1.5 wt. %.

3. The component of claim 1, wherein nickel is 25 to 30 wt. %; chromium is 30 to 40 wt. %; carbon is 1.5 to 2.0 wt. %; manganese is 0.50 to 1.50 wt. %; silicon is 0.25 to 1.5 wt. %; and having a minimum of 25% carbides within an austenite phase having at least 9 wt. % chromium.

4. The component of claim 1, wherein nickel is 25 to 30 wt. %; chromium is 30 to 40 wt. %; carbon is 1.5 to 2.0 wt. %; manganese is 0.50 to 1.50 wt. %; and silicon is 0.5 to 2 wt. %.

5. The component of claim 1, wherein nickel is 25 to 30 wt. %; chromium is 35 to 40 wt. %; carbon is 1.5 to 2.0 wt. %; manganese is 0.25 to 1.50 wt. %; silicon is 0.25 to 2 wt. %; and 0 to 0.5 wt. % copper.

6. The component of claim 1, wherein the aluminum is 0.25 to 1.25 wt. %.

7. The component of claim 1, having one or more surface (s) subject to a nitrogen, carbon, or boron diffusion thermal treatment after casting.

8. The component of claim 1, wherein a hard coating comprised of carbon or nitrogen is applied to said component and forms a topcoat with hardness in excess of 1200 HVN.

9. The component of claim 1, wherein said component is heat treated at a temperature in a range of from 200° C. to 650° C.

10. The component of claim 1, wherein said component is heat treated at a temperature in a range of about from 200° C. to 650° C. and then cooled down below 0° C.

11. The component of claim 1, where said component is an impeller, a propeller, a diffuser, a flow diverter, a slinger, a ring, a seat, or a spacer.

12. A method for manufacturing a component made from an alloy, said method comprising:

a) casting an austenite alloy to obtain a near-shape of a desired article, wherein the austenite alloy has a composition consisting of: 25 to 35 wt. % nickel; 25% to 42.5 wt. % chromium; 1.5 to 2.5 wt. % carbon; 0.5 to 2.0 wt. % manganese; 0.25 to 2.0 wt. % silicon; 0 to 1.5 wt. % aluminum; 0 to 0.5 wt. % of a combination of titanium, niobium, and tantalum, 0 to 1.0 wt. % copper, residual elements 0 to 0.5 wt. %, and having iron as the remainder to bring the total percentage to 100 wt. %;

b) machining said near-net shape to obtain a final shape of said article; and c) surface treating said article with nitrogen, carbon or boron, and/or a coating selected from TiN, TiAlCrN, TiAlN, CrN, Ti (B,C,N), TiCN, and DLC;

wherein said component is part of an electric submersible pump.

13. The method of claim 12, said austenite alloy having a minimum of 25% carbides within an austenite phase having at least 9 wt. % chromium.

14. The method of claim 12, wherein said austenite alloy has 25 to 30 wt. % Ni, 30 to 40 wt. % Cr; 1.5 to 2.0 wt. % C; 0.50 to 1.50 wt. % Mn; and 0.25 to 1.5 wt. % Si.

15. The method of claim 12, wherein said austenite alloy has 25 to 30 wt. % Ni; 30 to 40 wt. % Cr; 1.5 to 2.0 wt. % C; 0.50 to 1.50 wt. % Mn; and 0.5 to 2 wt. % Si.

16. The method of claim 12, wherein said austenite alloy has 25 to 30 wt. % Ni; 35 to 40 wt. % Cr; 1.5 to 2.0 wt. % C; 0.5 to 1.50 wt. % Mn; 0.25 to 2 wt. % Si; and 0 to 0.5 wt. % copper.

17. The method of claim 12, wherein said austenite alloy has 0.25-1.25 wt. % Si.

* * * * *